US007178937B2

(12) United States Patent
McDermott

(10) Patent No.: US 7,178,937 B2
(45) Date of Patent: Feb. 20, 2007

(54) LIGHTING DEVICE AND METHOD FOR LIGHTING

(76) Inventor: Vernon McDermott, 60-41 83 St., Middle Villiage, NY (US) 11379

( * ) Notice: Subject to any disclaimer, the term of this patent is extended or adjusted under 35 U.S.C. 154(b) by 16 days.

(21) Appl. No.: 10/763,650

(22) Filed: Jan. 23, 2004

(65) Prior Publication Data

US 2005/0162845 A1 Jul. 28, 2005

(51) Int. Cl.
*F21V 14/02* (2006.01)
*F21V 14/04* (2006.01)

(52) U.S. Cl. ..... 362/187; 362/418; 362/277; 362/285; 362/319

(58) Field of Classification Search ..... 362/523, 362/532, 250, 508, 512, 277, 282–289, 319, 362/418, 800, 419, 422–424, 449, 524, 526, 362/197, 187, 188
See application file for complete search history.

(56) References Cited

U.S. PATENT DOCUMENTS

| | | | | |
|---|---|---|---|---|
| 1,674,650 | A * | 6/1928 | Leser | 362/188 |
| 3,134,906 | A | 5/1964 | Henker | 250/211 |
| 3,990,430 | A | 11/1976 | Robertson | 126/271 |
| 4,099,516 | A | 7/1978 | Caulier | 126/271 |
| 4,271,408 | A | 6/1981 | Teshima et al. | 340/702 |
| 4,390,931 | A | 6/1983 | Gorick et al. | 362/267 |
| 4,665,895 | A | 5/1987 | Meier | 126/438 |
| 4,893,223 | A | 1/1990 | Arnold | 362/265 |
| 4,951,179 | A | 8/1990 | Machida | 362/61 |
| 4,963,798 | A | 10/1990 | McDermott | 315/312 |
| 4,984,140 | A | 1/1991 | Ellion | 362/187 |
| 5,093,768 | A | 3/1992 | Ohe | 362/241 |
| 5,101,326 | A | 3/1992 | Roney | 362/61 |
| 5,119,174 | A | 6/1992 | Chen | 357/80 |
| 5,136,483 | A | 8/1992 | Schöniger et al. | 362/61 |
| 5,148,146 | A | 9/1992 | Murphy | 340/461 |
| 5,171,086 | A * | 12/1992 | Baloochi | 362/188 |
| 5,224,773 | A | 7/1993 | Arimura | 362/227 |
| 5,235,498 | A | 8/1993 | Van Dulmen et al. | 362/296 |
| 5,237,490 | A | 8/1993 | Ferng | 362/183 |
| 5,302,965 | A | 4/1994 | Belcher et al. | 345/31 |
| 5,424,927 | A | 6/1995 | Schaller et al. | 362/157 |
| 5,490,049 | A | 2/1996 | Montalan et al. | 362/240 |
| 5,534,718 | A | 7/1996 | Chang | 257/98 |
| 5,567,036 | A | 10/1996 | Theobald et al. | 362/80 |
| 5,580,156 | A | 12/1996 | Suzuki et al. | 362/184 |
| 5,632,551 | A | 5/1997 | Roney et al. | 362/249 |
| 5,642,933 | A | 7/1997 | Hitora | 362/243 |
| 5,838,247 | A | 11/1998 | Bladowski | 340/815.45 |
| 5,890,794 | A | 4/1999 | Abtahi et al. | 362/294 |
| 5,929,788 | A | 7/1999 | Vukosic | 340/908.1 |
| 5,931,562 | A | 8/1999 | Arato | 362/184 |

(Continued)

*Primary Examiner*—Sandra O'Shea
*Assistant Examiner*—Bao Q. Truong
(74) *Attorney, Agent, or Firm*—Morgan & Finnegan, L.L.P.

(57) ABSTRACT

A lighting device that enables use of one or more light-emitting diodes (LEDs) in combination with a reflector is described. The subject lighting device includes at least one LED on a supporting portion, such that the LED is located in front of and aimed toward a reflector. Light emitted from the LED is reflected by the reflector and travels past the LED to provide light. The light-emitting diode(s) may be substantially centrally located with respect to a central axis of a reflector. Focusability of the lighting device is achieved by adjusting the relative distance between the LED and reflector, or by other means.

22 Claims, 13 Drawing Sheets

U.S. PATENT DOCUMENTS

| | | | | |
|---|---|---|---|---|
| 5,947,587 | A | 9/1999 | Keuper et al. | 362/235 |
| 6,016,038 | A | 1/2000 | Mueller et al. | 315/291 |
| 6,026,602 | A | 2/2000 | Grondal et al. | 40/570 |
| 6,095,661 | A | 8/2000 | Lebens et al. | 362/184 |
| 6,149,283 | A | 11/2000 | Conway et al. | 362/236 |
| 6,168,288 | B1 | 1/2001 | St. Claire | 362/184 |
| 6,220,722 | B1 | 4/2001 | Begemann | 362/231 |
| 6,334,700 | B2 | 1/2002 | Ramer et al. | 362/298 |
| 6,367,950 | B1 | 4/2002 | Yamada et al. | 362/245 |
| 6,452,217 | B1 | 9/2002 | Wojnarowski et al. | 257/99 |
| 6,461,008 | B1 | 10/2002 | Pederson | 362/35 |
| 6,481,130 | B1 | 11/2002 | Wu | 40/546 |
| 6,485,160 | B1 | 11/2002 | Sommers et al. | 362/184 |
| 6,485,170 | B2 | 11/2002 | Natsume | 362/509 |
| 6,492,954 | B2 | 12/2002 | Gau et al. | 343/776 |
| 6,499,859 | B2 | 12/2002 | Petzl et al. | 362/184 |
| 6,527,419 | B1 | 3/2003 | Galli | 362/308 |
| 6,530,679 | B1 | 3/2003 | Nishioka | 362/339 |
| 6,536,912 | B2 | 3/2003 | Parker | 362/206 |
| 6,537,890 | B2 | 3/2003 | Joo et al. | 438/404 |
| 6,547,410 | B1 | 4/2003 | Pederson | 362/35 |
| 6,558,032 | B2 | 5/2003 | Kondo et al. | 362/516 |
| 6,572,246 | B1 | 6/2003 | Hopp et al. | 362/298 |
| 6,609,804 | B2 | 8/2003 | Nolan et al. | 362/20 |
| 6,616,313 | B2 | 9/2003 | Fürst et al. | 362/494 |
| 6,648,490 | B2 * | 11/2003 | Klose | 362/232 |
| 6,733,156 | B2 * | 5/2004 | Chen | 362/245 |
| 2003/0156416 | A1 | 8/2003 | Stopa et al. | 362/294 |

* cited by examiner

LIGHTING DEVICE AND METHOD FOR LIGHTING

The present invention relates to the field of lighting devices. More specifically, the present invention relates to lighting devices utilizing light-emitting diodes as a light source. Some embodiments of the present invention relate to use in a flashlight, portable hand lantern or other similar portable lighting device, while other embodiments of the present invention relate to lighting devices that are permanently or semi-permanently installed in a location.

DESCRIPTION OF RELATED ART

One problem with using LEDs as a light source is that the light emitted from LEDs travels in substantially one direction, with a majority of their light being spread at a fixed angle, usually between 5 and 50 degrees (typically greater than 10 degrees). Heretofore there has been no practical way of narrowing the beam spread to be less than 4-degrees, nor has there been a way for providing an adjustability to the beam spread of a LED lighting device. An incandescent light bulb, in comparison, will typically emit light in every direction (with the exception of the direction of its base). Similarly, fluorescent tubes emit light in virtually all directions, depending on their particular shape.

As a result of the above drawbacks to using light-emitting diodes (LEDs), lighting devices utilizing LEDs as light sources typically are constructed so as to arrange LEDs in a direct-view manner. That is, when looking at typical LED devices, one will see light coming directly from the LEDs, or through a protective filter or cover, and otherwise directly from the LEDs. Due to the limitations of LEDs resulting from the substantially uni-directional light output and broad beam spread thereof, it has been necessary to manufacture LED flashlights and other portable LED-based lighting devices with one or a plurality of LEDs mounted on the device, with the LEDs projecting light directly or through a cover or filter. With these devices, however, instead of providing a bright "spot" pattern, they provide a more diffuse pattern that does not concentrate light in one small area, but across a wider area. This is often undesirable in instances where a user desires only to light a small area for viewing detail.

BRIEF SUMMARY OF THE INVENTION

One object of the subject lighting device is to overcome the drawbacks of other devices by providing a practical and economical means for applying LED technology to portable lighting devices. Another object of the subject lighting device is to provide a practical means for achieving a focusable lighting device using a LED as a light source, a focus being pre-selected prior to or at the time of manufacture, or alternatively, adjustable by a user following manufacture.

Accordingly, the subject lighting device includes a structure that allows use of a reflector in adjusting a beam pattern. The beam spread or pattern may be adjusted to a predetermined size, in one embodiment, during the manufacture of the lighting device such as that of a relatively narrow-angle "spotlight," or relatively wide-angle "floodlight," is achieved. Additionally, a substantially rectangular pattern may be achieved using a condensing lens located in-front of the reflector. In another embodiment, the focus of the subject lighting device is manufactured so as to be user-adjustable.

In still another embodiment, the focus is fixed during or following manufacture at a predetermined beam spread.

Many embodiments of the subject lighting device incorporate the use of an LED light source mounted in front of a reflector or other reflecting surface, light being emitted from the LED, reflected off of the reflector or reflecting surface, then past the LED to provide a directed beam. The light source may, alternatively, be an incandescent, fluorescent or other light source. The light source may also comprise multiple lamps or LEDs (multiple individual light sources). As a further alternative, there may be a mix of types of lamps (LEDs and incandescent lamps, for example) for the purposes of tailoring the overall light quality (temperature, hue, etc.) to a particular application or to suit the preference of a user.

Depending on the embodiment, the subject lighting device provides for focusability by adjusting the relative distance between the light source and a reflector and/or lens. Such focusability may be pre-selected during the manufacture of the subject lighting device or may be adjustable by a user (following manufacture).

DETAILED DESCRIPTION OF THE INVENTION

Figure 1:
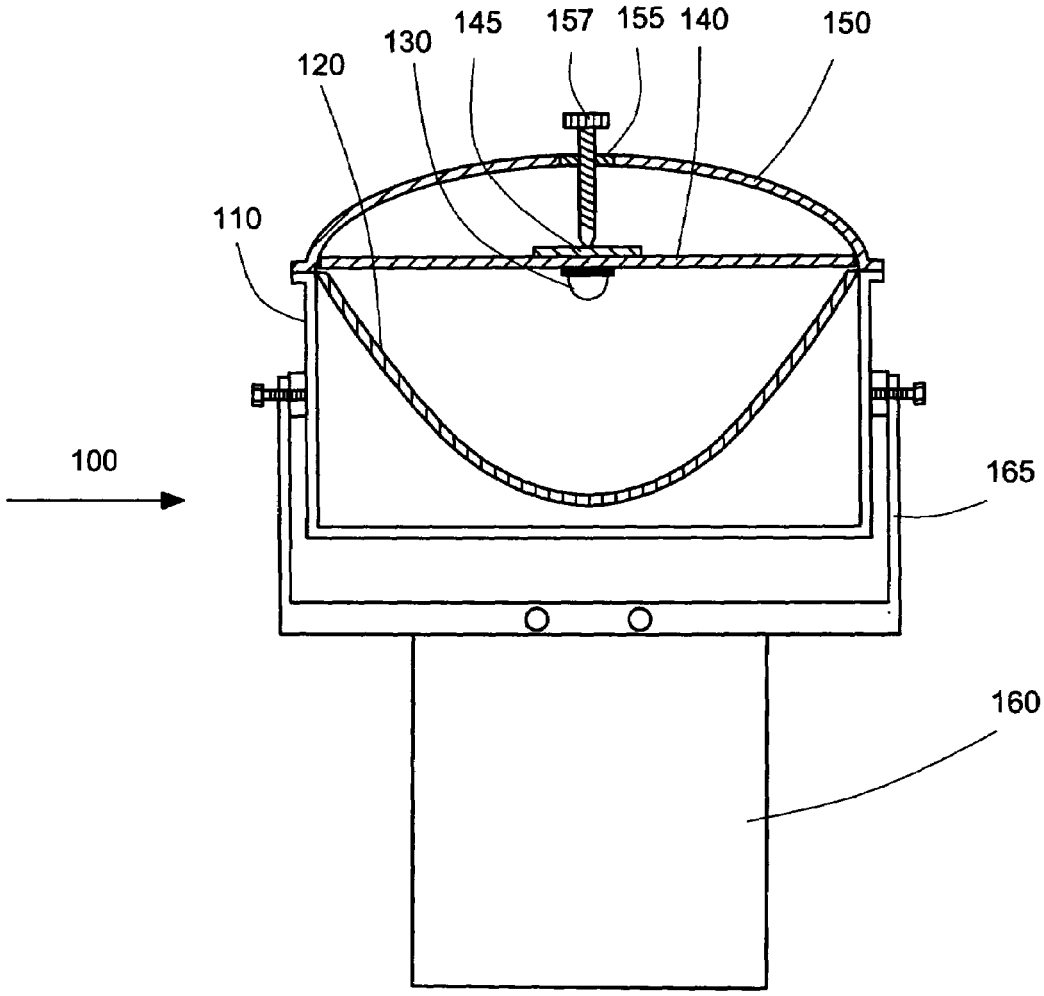
FIG. 1 is a partial cross-sectional view of one embodiment of the subject lighting device.

FIG. 1 is a partial cross-sectional view of one embodiment of the subject lighting device 100. A housing 110, a portion the lighting device 100, houses a reflector 120 secured to the housing 110, a lens or filter 150, which in conjunction with the housing 110, acts to protect a space defined by the housing 110 and filter 150, in which the reflector 120 and other components are arranged. In-front of the reflector 120, with respect to a longitudinal axis of the housing 100, is a LED light source 130, which may comprise a single LED or a plurality of LEDs. For the purposes of simplifying this discussion, the LED light source 130 will simply be referred to in the singular, but it should be understood that a plurality of LEDs may be incorporated. In this embodiment, the LED 130 is oriented in-front of the reflector, and arranged so as to direct a majority of the light output therefrom toward the reflector 120. In other embodiments, it may be preferable to include a plurality of reflectors, at least some of which are not directly behind the LED 130.

In this embodiment, the LED 130 is mounted on a supporting frame 140. The supporting frame suspends the LED 130 in a position relative to the reflector that produces a desired beam spread (wide-angle/flood, narrow-angle/spot). The beam spread may be predetermined during the manufacture or user-adjustable.

Figure 2:
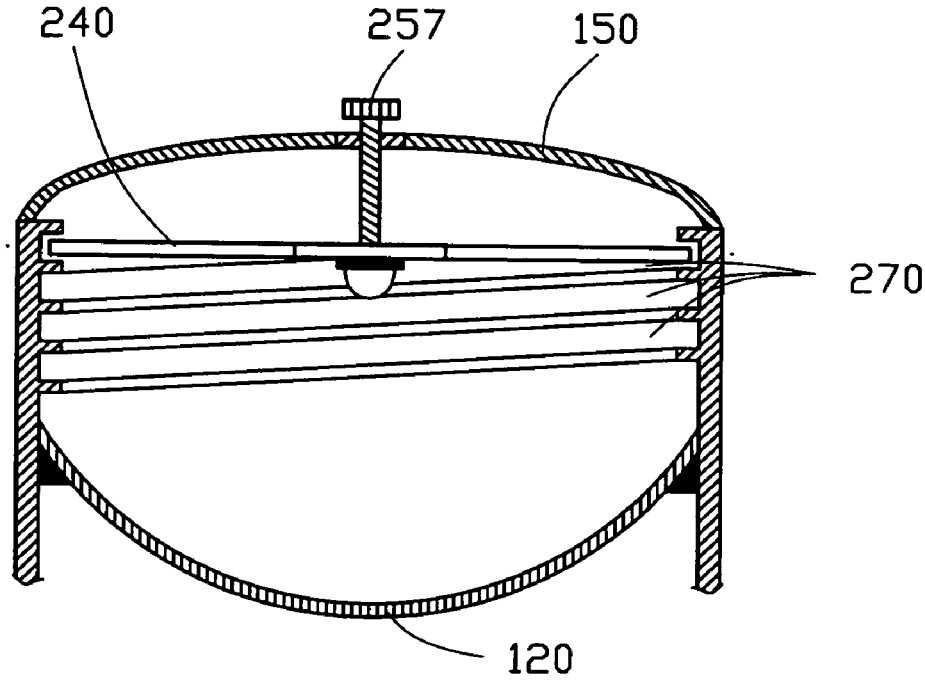
FIG. 2 illustrates a second embodiment of the subject lighting device.
Figure 3:
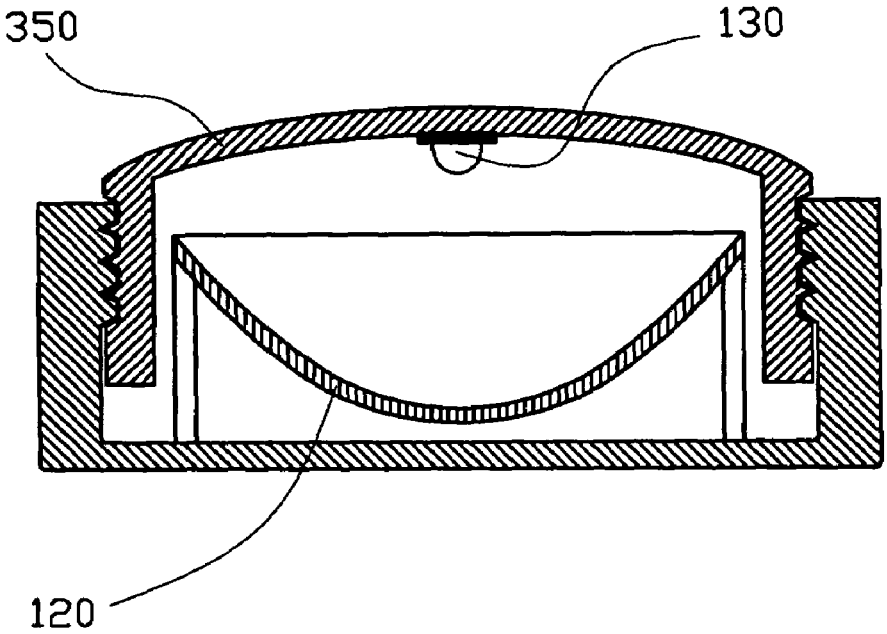
FIG. 3 illustrates a third embodiment of the subject lighting device.

Focusability of light in the subject lighting device 100 may be achieved in a variety of manners. In one embodiment, the LED is suspended above the reflector on a flexible support frame 140. A screw 157 behind the LED 130, when turned, applies a force on a LED base plate 145 or on the back of the flexible support frame 140, which moves the LED toward or away from the reflector. The screw 157 may be held by a grommet 155 to reinforce the lens/filter 150. As shown in FIG. 2, an alternate means for achieving axial translation of the LED 130 relative to the reflector 120 and/or housing 110 includes providing the lighting device 100 with a helical groove 270 in which the supporting frame 240 sits, as may be seen in FIG. 2. When desired, the LED 130 and the supporting frame 240 may be turned, in this embodiment, by screw 257. Thereby, the axial position of the LED 130 is adjusted. As shown in FIG. 3, if the LED 130 is mounted to the lens/ filter 350, then the entire lens/filter 350 may be rotated to bring about axial translation of the LED 130.

In any embodiment in which the LED 130 itself rotates, power may be supplied in any known means. A power supply may be in the base 160 of the lighting device 100, elsewhere in the lighting device, or may be supplied from an external source, such as a vehicle power supply. Because LEDs typically require a lower voltage than other light sources, a transformer, resistor or other voltage reducing circuitry will typically be required, unless run off of a battery power supply with an appropriate voltage output.

Power supply wires (not shown) may be provided with enough slack that a maximum number of turns of the LED 130 will not damage the wires. Alternatively, contacts may be placed within the housing 110 and on moving parts so that as the LED 130 rotates, conduction may continuously occur.

Figure 4:
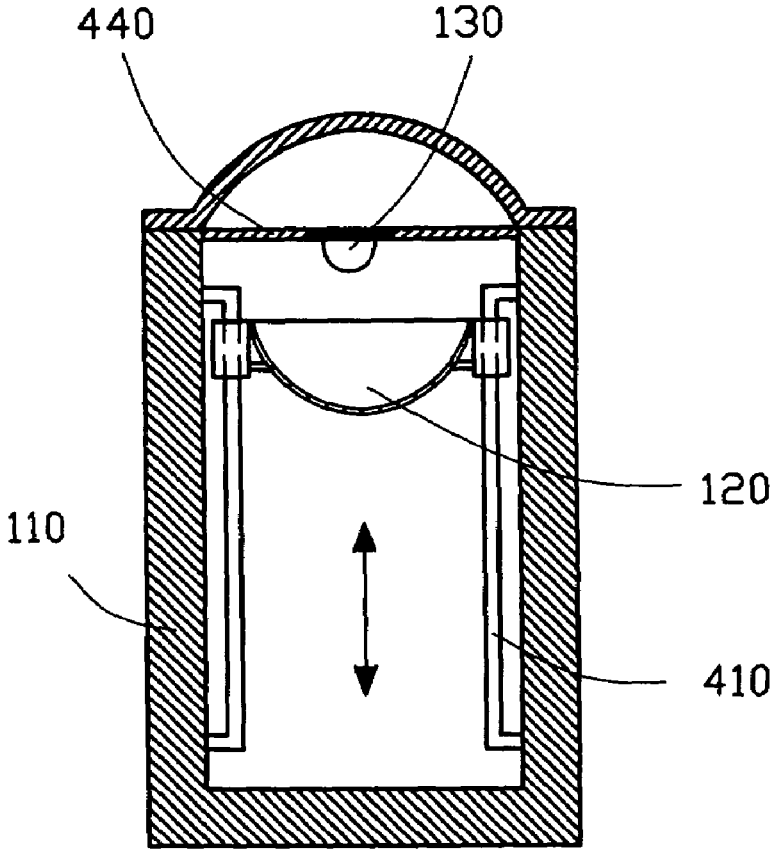
FIG. 4 illustrates an alternate embodiment of a reflector of the subject lighting device.

Instead of or in addition to an axially translating LED 130, the reflector 120 may also translate along the longitudinal axis of the housing 110. As seen in FIG. 4, to achieve a axially translating reflector, the housing 110, for example, may have one or more linear guides 410 on its interior surface along which the reflector may travel. Alternatively, the reflector 120 may simply move linearly via a screw-type interface or another means.

Moreover if an optical lens 150 is incorporated into the lighting device instead of a simple filter, the lens 150 may translate along the longitudinal axis of the housing 110, in order to achieve an adjustable beam spread. Such an adjustable lens 150 may be in addition to or in place of a translating or shape-changing reflector 120,420, and may be embodied with an interface similar to the rotating/ axially translating filter shown in FIG. 3.

By adjusting the relative position between the LED 130 and the reflector 120, either a relatively narrow or relatively wide beam spread may be achieved, depending on the relative position of the LED 130 and reflector 120.

Figure 5A:
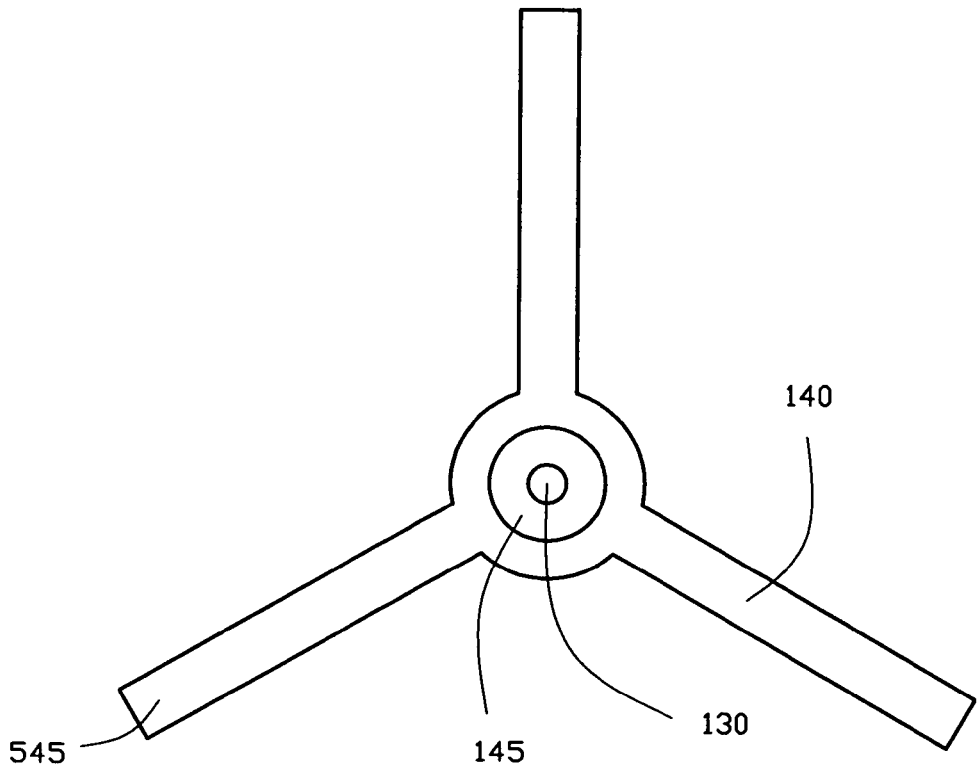
FIGS. 5A and 5B illustrate one embodiment of a supporting portion of the subject lighting device.
Figure 5B:
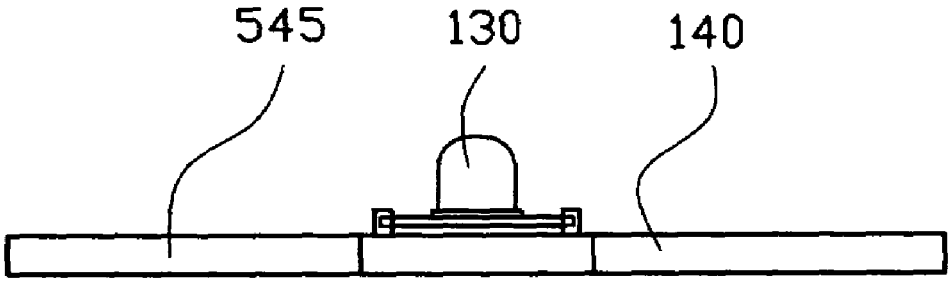

The supporting frame 140 may comprise a shaped flexible material, in-particular a plastic, in-particular a see-through plastic. Alternatively, the supporting frame 140 may be made from a metal. FIGS. 5A and 5B illustrate the supporting portion 540 as having three substantially flat prongs 545. In the embodiment shown in FIG. 1, the prongs sit on the surface of the reflector, typically near the top of the reflector 120 near its upper edge. Typically, the supporting frame 140 will be arranged in such a manner that unless an external force is applied to the supporting frame 140, it will hold the LED 130 at a neutral, resting position. As described above, there are a number of ways to achieve an axial translation of the LED 130 relative to the reflector 120. In the embodiment of FIG. 1, however, typically a force is applied from the adjusting screw 157 to deflect the supporting frame 140 and LED 130 toward the reflector.

Figure 6:
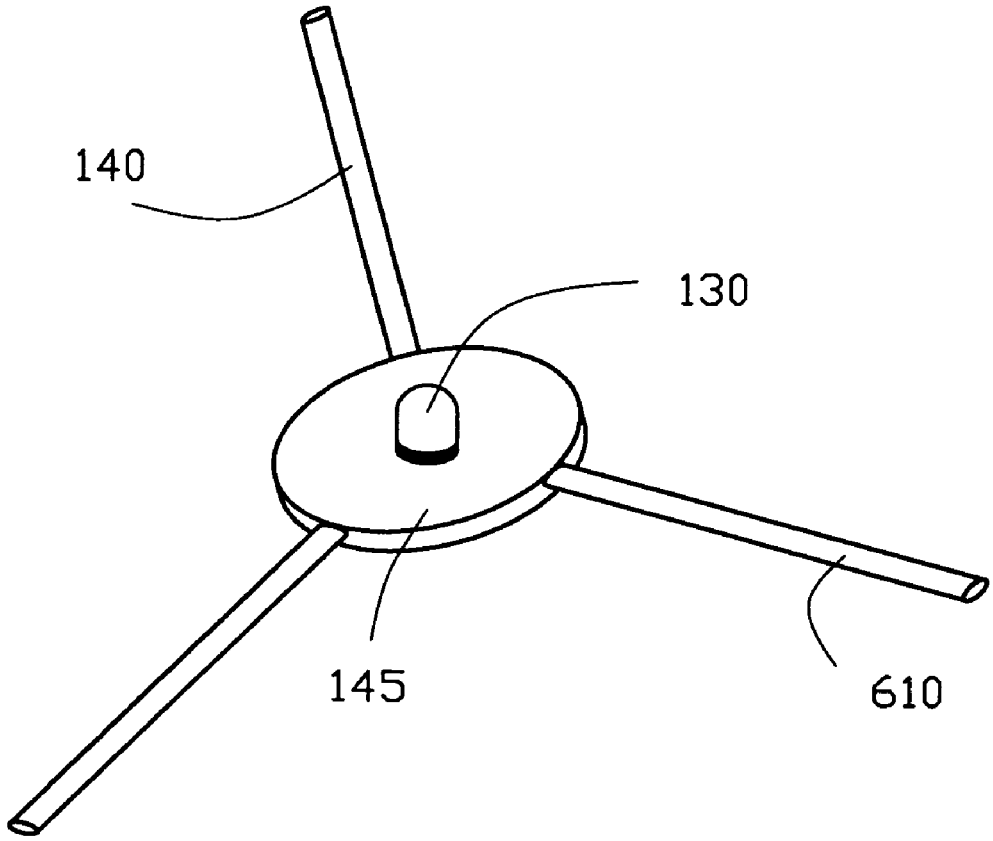
FIG. 6 illustrates a second embodiment of a supporting portion of the subject lighting device.

FIG. 6 illustrates an alternate type of LED supporting frame 140, comprising resilient cylindrical prongs 610. These prongs 610 act similarly to the prongs shown in FIG. 5, to support the LED 130 in the space in-front of the reflector 120. The prongs 610, in this embodiment, may be made from a plastic or a metal, such as a spring steel, but may be manufactured of another suitable material. The prongs 610 ride on the reflector 120 or another guide and are thereby provided support. The LED 130 and its base 145, are either held in position by the rigidity of the supporting frame 610, through a permanent deformation of the supporting frame 610, or through the influence of a secondary force, such as that from the adjusting screw 157 or a non-adjustable, permanently fixed secondary support (not shown) for urging the LED 130 into a desired position. In this or other embodiments, when the supporting frame 140 is manufactured out of a conductive material, the supporting frame 140 may conduct the power to the LED 130 necessary for operation.

Alternatively, if the supporting frame 140 is made from a material with a suitable surface area, conductors may be applied to one or more surfaces thereof. For example, a thin, conductive metal strip with an adhesive backing may be applied to the supporting frame 140, or conductors may be silk-screened onto the supporting frame 140. As described above, the power may be carried to the LED 130 by way of wires (not shown).

Figure 7:
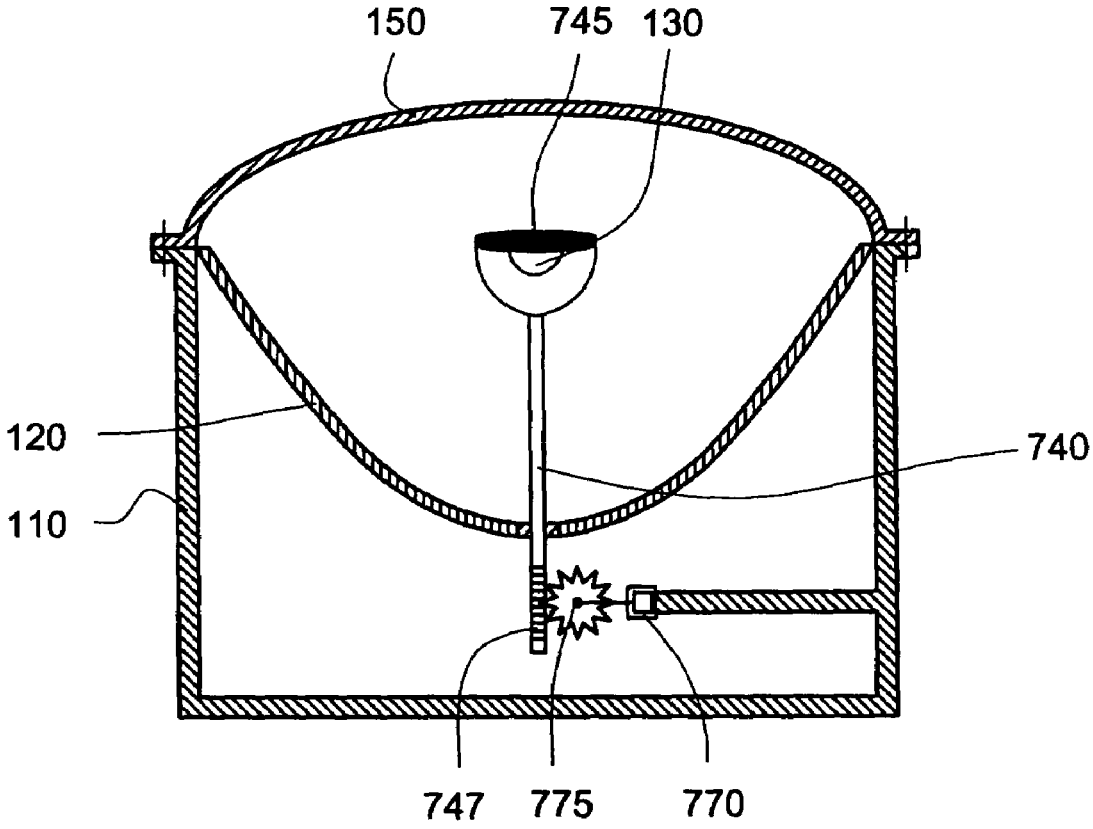
FIG. 7 illustrates a third embodiment of a supporting portion of the subject lighting device.

In an alternate embodiment shown in FIG. 7, the LED 130 is supported by a supporting frame 740 that is oriented substantially along the central axis of the reflector 120 and housing 110. The LED 130 is oriented so as to emit a majority of its light toward the reflector 120. The supporting frame 740 may be user-adjustable or may be fixed at a pre-determined position during manufacture to achieve a desired beam spread. If adjustable, the supporting frame 740 may be provided with teeth 747 that mesh with a gear 775. The gear 775 may be powered by a motor 770 or by manual means. Alternatively, relative linear movement between the supporting frame 740 and reflector 120 may be achieved in another manner. Further, in this embodiment, power may be supplied to the LED 130 through the supporting frame 740.

The beam spread of the subject lighting device 100 is dependent on the specific embodiment. That is, there are a number of variables that are typically selected prior to manufacture, including the precise type of reflector 120. The shape of the reflector 120 will inpart determine the behavior of the light output from the lighting device 100. Naturally, the nearer the LED 130 to the focus of the mirror, the more the beam spread will approach a spot pattern, as all light rays will be leave the reflector approximately parallel to each other and to a central axis of the lens.

FIGS. 8A–E illustrate example paths that light rays emitted from the LED 130 may take, depending on the position of the LED relative to the reflector 120. In FIGS. 8A–E, rays emanating from only for one side of the of the LED are depicted to facilitate understanding by the reader.

Figure 8A:
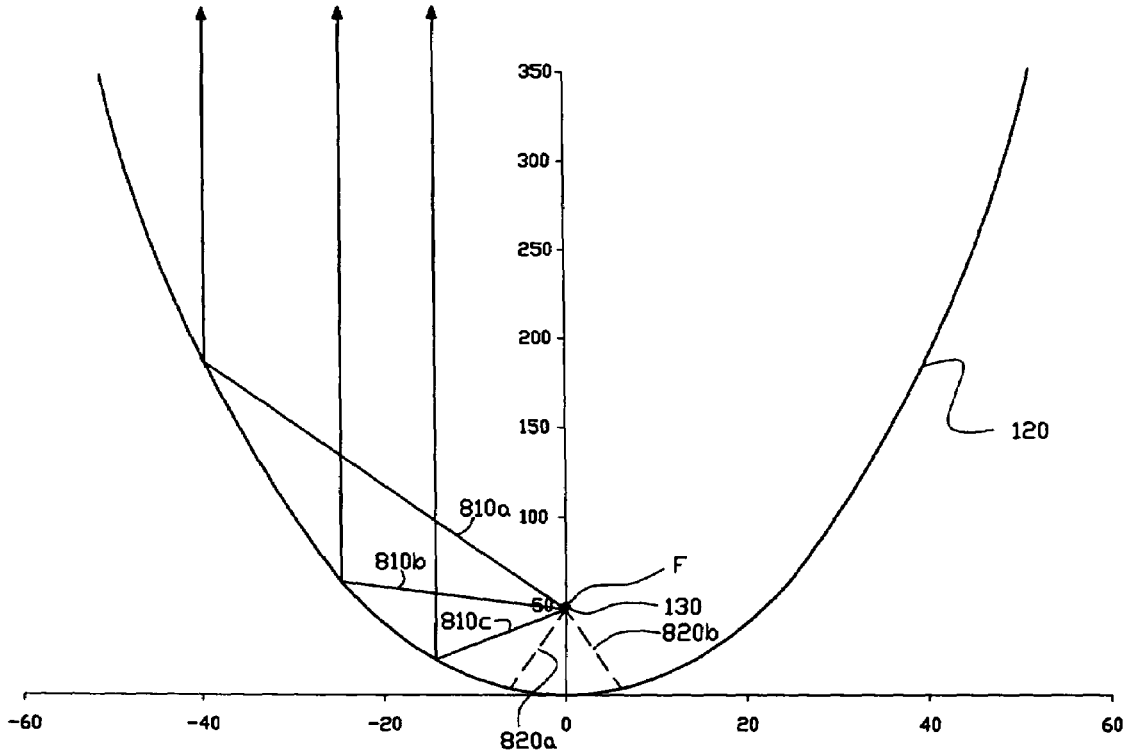
FIGS. 8A–8E illustrate paths of example light rays emanating from locations at selected distances from a parabolic reflector.
Figure 8B:
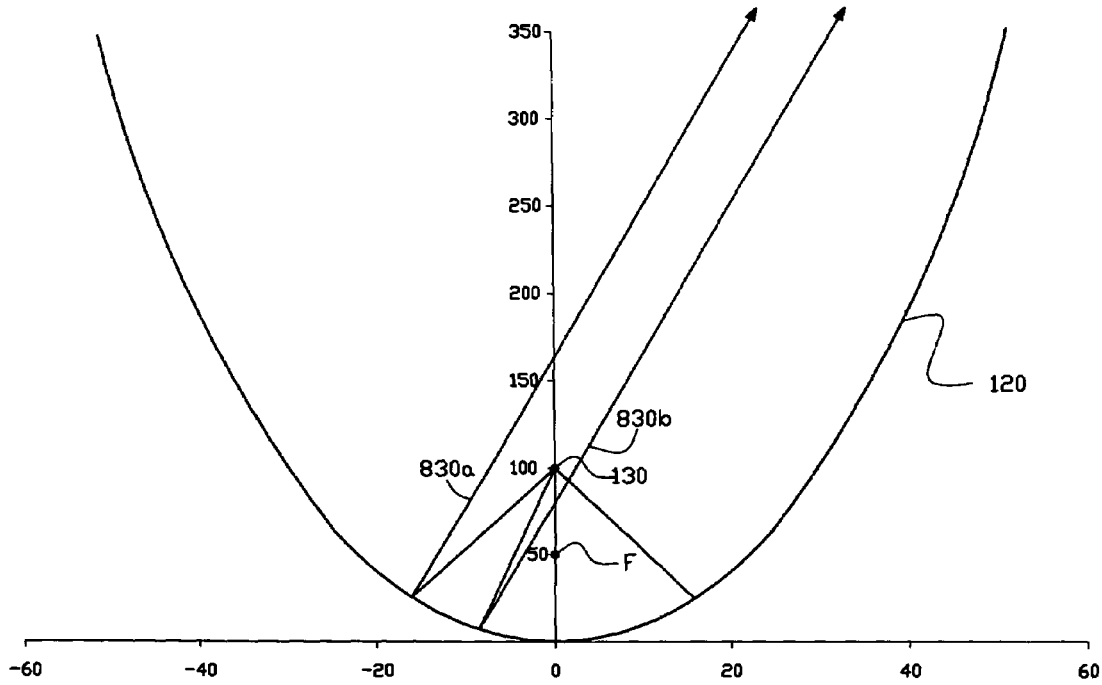

FIG. 8A illustrates the position of the focus F of the particular cross-section of the parabolic reflector illustrated in FIGS. 8A–E. Light hitting the reflector perpendicular to the central axis of the reflector will be reflected to the focus F. Similarly, light emitted from a LED 130 arranged about the focus F will be reflected and will leave the lighting device 100 substantially perpendicularly to the axis of the reflector 120.

However, with the LED 130 located at the focus F and arranged such that it is directed substantially downward toward the bottom-most point of the reflector, current LEDs would not be able to emit a substantial amount of light in the direction of ray 810*a* or even 810*b* or 810*c*. One of the limitations of LEDs set forth above in the Background of the Invention section, is that they typically emit light in a substantially uni-directional manner. As such, a typical LED will not be able to project much light beyond the angles and outside of the area defined by lines 820*a* and 820*b*. FIGS. 8B–E, however, illustrate the behavior of the light when the LED is placed further from the reflector 120 than the Focus F.

Figure 8C:
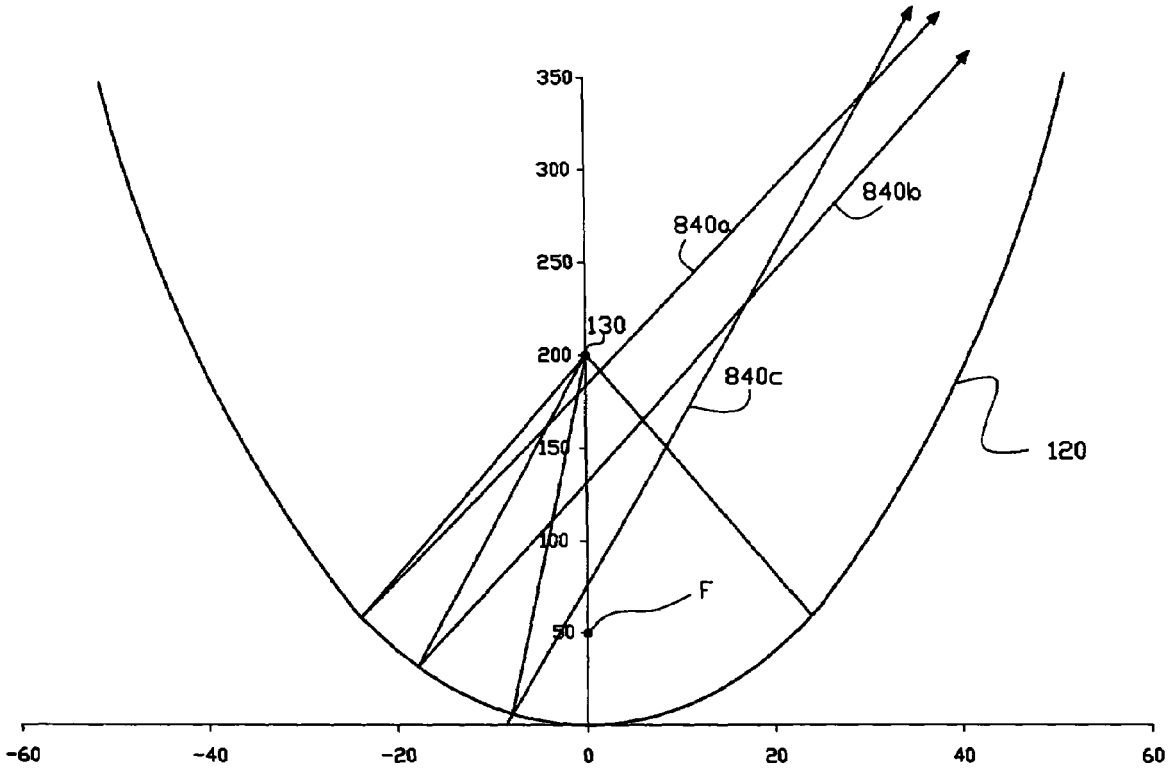
Figure 8D:
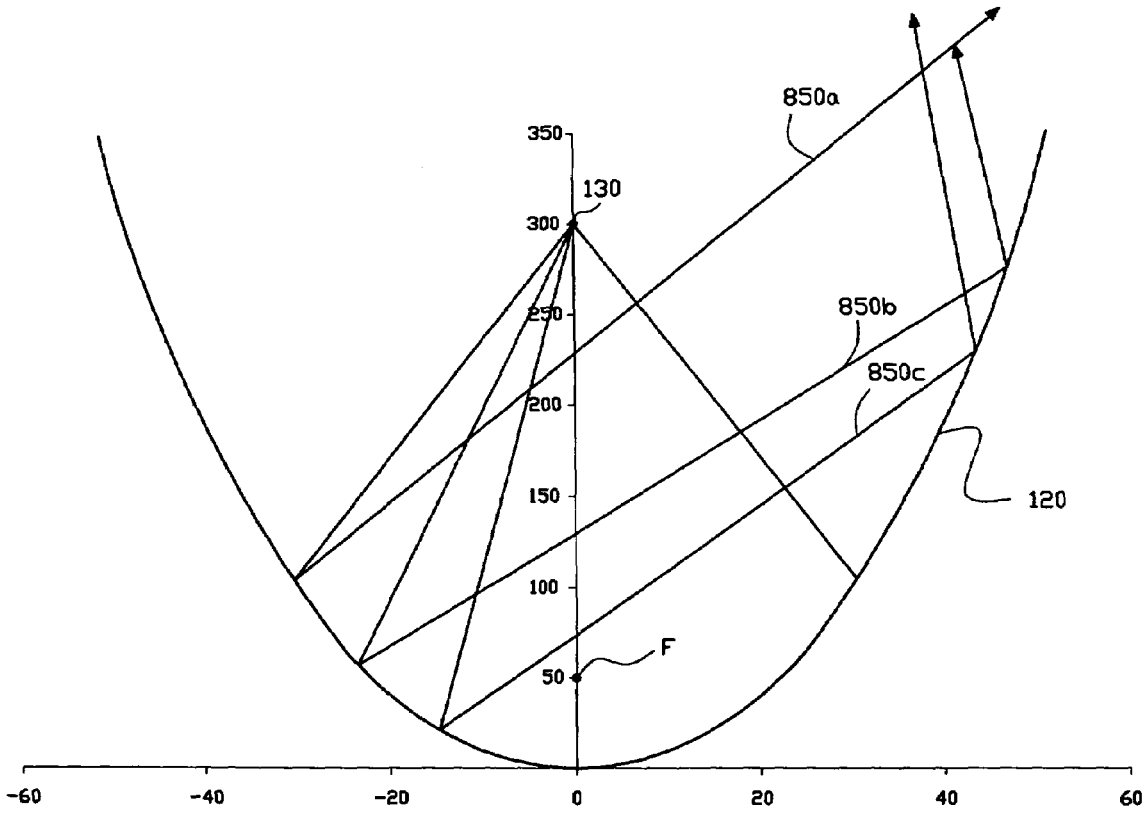
Figure 8E:
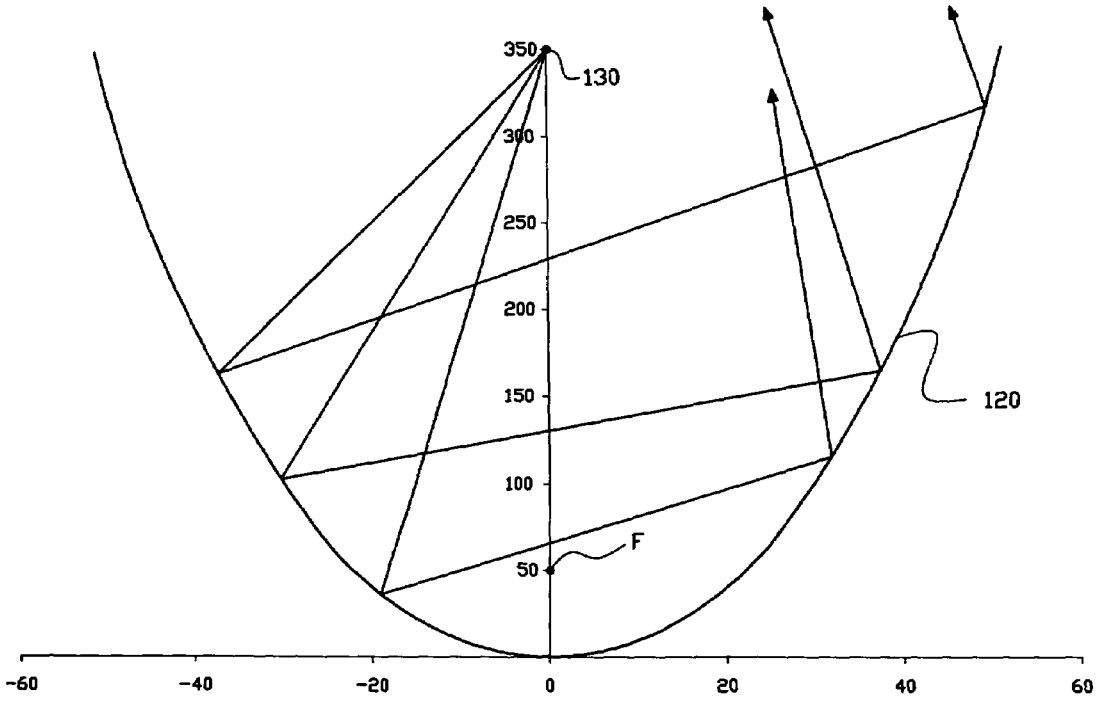

The specific size of an area lighted by the lighting device 100 depends in part on the distance the lighting device 100 is located from the area to be lighted, since if the light rays are not perfectly parallel to the axis, they will ultimately diverge from the central axis and create a wider beam as they travel further from the lighting device 100. For example, the position of the LED 130 in FIG. 8B yields two example rays 830*a* and 830*b* that diverge from the center axis as they leave the reflector area. FIG. 8C illustrates example rays 840*a*–840*c* that diverge from the central axis at an even greater angle than rays 830*a* and 830*b* of FIG. 8B. However, FIG. 8D illustrates a position of the LED 130 that yields a substantially converging set of rays 850. Rays 850*b* and 850*c*, upon leaving the reflector area are clearly angled toward the central axis of the reflector 120. Ray 850*a*, however, has missed the reflector and diverges from the central axis. If, however, the reflector were larger than that illustrated here, this ray 850*a* too, would be angled toward the central axis. FIG. 8E illustrates a LED 130 position that results in an more marked convergence of the rays upon leaving the reflector area.

As stated above, however, if the rays are not parallel upon leaving the reflector, they will ultimately diverge. In the case of the position of the LED 130 shown in FIGS. 8D and 8E, prior to diverging, the rays will converge and form a spot pattern at a distance from the lighting device 100. Since the position of the LED 130 may be adjustable, the distance at which a spot pattern is formed may also be adjustable.

In alternate embodiments, the subject lighting device may be affixed in a permanent or semi-permanent manner, such as in a building for general or accent lighting, in special-effect displays, in outdoor lighting fixtures, warning beacons on vehicles for interior lighting, headlights or warning beacons on the vehicle.

When used as a warning beacon, the lighting device 100 may be arranged on a rotating or oscillating base or frame, such that at least the reflector 120 and LED 130 rotate or oscillate as a unit, thereby providing a flashing effect from the perspective of a viewer, alerting the viewer to the presence of the beacon and a thereby providing a warning of a potential hazard.

It is to be understood that though specific embodiments and examples are set forth herein, that the spirit of the invention may be applied in situations and embodiments not specifically set forth herein.

The invention claimed is:

1. A lighting device having at least one light-emitting diode as a light source, the lighting device comprising:

a housing;

a reflector, which has a central axis, mounted at least partially in the housing;

said at least one light-emitting diode mounted in the housing on a front side of the reflector, arranged so that at least a substantial majority of light output from the light-emitting diode is reflected off the surface of the reflector and past the light-emitting diode;

a supporting element arranged in-front of the reflector for supporting the light-emitting diode; a protective filter or lens attached to the housing, protecting the light-emitting diode and reflector, and preventing soiling of the reflector; and a focusing portion enabled to adjust a relative position between the light-emitting diode and the reflector in a direction substantially parallel to the central axis, the relative position of the light-emitting diode and the reflector determining the beam spread projecting from the lighting device.

2. The lighting device of claim 1, wherein the supporting element is manufactured from a transparent material.

3. The lighting device of claim 1, wherein the supporting element is manufactured from a resilient material.

4. The lighting device of claim 1, wherein the supporting element is manufactured from a metal wire.

5. The lighting device of claim 1, wherein the supporting element is mounted to the housing in a location on a back side of the reflector, the supporting element passing through the reflector to the front side of the reflector.

6. The lighting device of claim 1, wherein the focusing portion comprises a linear actuator mounted in the protective filter or lens, substantially normal to the surface thereof, the linear actuator adjusting the distance between the light-emitting diode and the reflector, thereby adjusting the beam pattern of the lighting device.

7. The lighting device of claim 6, wherein the linear actuator is a screw, which, when turned in a first direction advances through the filter or lens, deflecting the supporting element and light-emitting diode toward the reflector.

8. The lighting device of claim 1, wherein the focusing portion comprises a screw mechanism arranged between the supporting element and the reflector, such that by rotating the supporting element in a first direction, the light-emitting diode is urged toward the reflector.

9. The lighting device of claim 8, wherein the screw mechanism is formed by at least two mating portions, a first mating portion being integral with the supporting portion.

10. The lighting device of claim 9, wherein a second mating is integral with the reflector.

11. The lighting device of claim 9, wherein a second mating portion is integral with the housing.

12. The lighting device of claim 8, wherein the screw mechanism is formed by at least two mating portions, a first mating portion being integral with the lens or filter.

13. The lighting device of claim 12, wherein a second mating portion is integral with the housing.

14. The lighting device of claim 1, wherein the reflector is a parabolic reflector and the first side of the reflector is substantially concave.

15. The lighting device of claim 1, wherein the reflector is a hyperbolic reflector and the first side of the reflector is substantially convex.

16. The lighting device of claim 1, wherein the adjusting portion adjusts a lateral position between the light-emitting diode and the reflector, the reflector having an elongated shape with a substantially parabolic cross-section, the cross-section of the reflector varying along a length of the reflector, such that when the light-emitting diode travels along the length of the reflector, the varying cross-section results in a varying beam pattern.

17. A light-emitting diode light source comprising:

at least one light emitting diode;

a reflector, which has a central axis, the light emitting diode being aimed substantially toward the reflector, arranged such that light being emitted by the light emitting diode reflects off of the reflector and past the light emitting; and a focusing portion enabled to adjust a relative position between the light-emitting diode and the reflector in a direction substantially parallel to the central axis, the relative position of the light-emitting diode and the reflector determining the beam spread projecting from the lighting device.

18. A lighting device comprising:

a parabolic reflector mounted within the lighting device, the reflector having a front side and a back side, the reflector having a central axis;

a light emitting diode arranged on the front side of the reflector, the light emitting diode being arranged substantially along the central axis of the reflector and directed substantially toward the reflector, such that light emitted by the light emitting diode reflects off of the reflector and subsequently exits the lighting; and a focusing portion enabled to adjust a relative position between the light-emitting diode and the reflector in a direction substantially parallel to the central axis, the relative position of the light-emitting diode and the reflector determining the beam spread projecting from the lighting device.

19. A method for providing focusability to a light emitting diode lighting device, the method comprising:

mounting said light emitting diode in front of and substantially directed toward a reflector, which has a central axis, light from the light emitting diode being reflected off of the reflector and past the light-emitting diode; and adjusting a distance between the light-emitting diode and the reflector in a direction substantially parallel to the central axis to adjust a beam spread emitted from the light-emitting diode lighting device.

20. A lighting device having a light-emitting diode as a light source, the lighting device comprising:

a housing;

a reflector, which has a central axis, mounted in the housing; said light-emitting diode mounted in the housing on a first side of the reflector, located substantially at a central axis of the reflector, the light-emitting diode arranged so that at least a substantial majority of light output from the light-emitting diode is reflected off the surface of the reflector and past the light-emitting diode;

a supporting element arranged in-front of the reflector for supporting the light-emitting diode; and a protective filter or lens attached to the housing, protecting the light-emitting diode and reflector; and preventing soiling of the and a focusing portion enabled to adjust a relative position between the light-emitting diode and the reflector in a direction substantially parallel to the central axis, the relative position of the light-emitting diode and the reflector determining the beam spread projecting from the lighting device.

21. A light-emitting diode light source comprising:

a housing;

a light emitting diode arranged substantially in the housing;

a supporting portion for supporting the light emitting diode within the housing, the supporting portion being substantially rigidly attached to the light emitting diode, such that when the supporting portion is moved or deformed, the light emitting diode moves respectively;

a reflector, which has a central axis, arranged at least partly within the housing, the light emitting diode being aimed substantially toward the reflector and arranged such that light being emitted by the light emitting diode reflects off of the reflector, past the light emitting; and a focusing portion enabled to adjust a relative position between the light-emitting diode and the reflector in a direction substantially parallel to the central axis, the relative position of the light-emitting diode and the reflector determining the beam spread projecting from the lighting device.

22. The lighting device of claim 1, wherein the relative position between the light-emitting diode and the reflector is adjusted along the central axis.

* * * * *

UNITED STATES PATENT AND TRADEMARK OFFICE

CERTIFICATE OF CORRECTION

PATENT NO. : 7,178,937 B2
APPLICATION NO. : 10/763650
DATED : February 20, 2007
INVENTOR(S) : Vernon McDermott It is certified that error appears in the above-identified patent and that said Letters Patent is hereby corrected as shown below:

In claim 17, line 7 (column 7, line 7), the word --diode-- should follow "emitting" but should precede the semicolon.
In claim 18, line 10 (column 7, line 23), the word --device-- should follow "lighting" but should precede the semicolon.
In claim 20, line 15 (column 8, line 10), the semicolon should be a comma.
In claim 20, line 16 (column 8, line 11), --reflector;-- should follow "soiling of the".
In claim 21, line 15 (column 8, line 32), --diode-- should follow "emitting" but should precede the semicolon.

Signed and Sealed this

Tenth Day of April, 2007

JON W. DUDAS
*Director of the United States Patent and Trademark Office*